US009383131B2

(12) United States Patent
Jeong et al.

(10) Patent No.: US 9,383,131 B2
(45) Date of Patent: Jul. 5, 2016

(54) REFRIGERATOR

(71) Applicant: SAMSUNG ELECTRONICS CO., LTD., Suwon-si (KR)

(72) Inventors: Jin Jeong, Yongin (KR); Do Hyung Kim, Yongin (KR); Sang Hyun Park, Seongnam (KR); Kook Jeong Seo, Suwon (KR); Jae Koog An, Gwangju (KR); Yong Sung Yoon, Goyang (KR); Jae Jin Lee, Gwangju (KR); Seung Ah Joo, Goyang (KR); Qasim Khan, Suwon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 634 days.

(21) Appl. No.: 13/785,402

(22) Filed: Mar. 5, 2013

(65) Prior Publication Data

US 2013/0227983 A1 Sep. 5, 2013

(30) Foreign Application Priority Data

Mar. 5, 2012 (KR) ..... 10-2012-0022471

(51) Int. Cl.

| | |
|---|---|
| ***F25D 23/06*** | (2006.01) |
| ***F25D 11/00*** | (2006.01) |
| *F25C 1/24* | (2006.01) |
| *F25D 21/04* | (2006.01) |

(52) U.S. Cl.

CPC ..... *F25D 11/00* (2013.01); *F25D 23/061* (2013.01); *F25C 1/24* (2013.01); *F25D 21/04* (2013.01)

(58) Field of Classification Search

CPC ..... F25D 23/068; F25D 2201/12; F25D 2201/00; F25D 2201/124; F25D 2201/126; F25D 2201/30; F25D 21/07; F25D 21/04; F16L 59/141; F24F 1/34; F24F 13/0263; F24F 13/20; F25C 2400/10

See application file for complete search history.

(56) References Cited

U.S. PATENT DOCUMENTS

2011/0000248 A1* 1/2011 Jeong ..... F25C 1/04 62/344

FOREIGN PATENT DOCUMENTS

| | | |
|---|---|---|
| KR | 10-2008-0015341 | 2/2008 |
| KR | 10-2010-0137637 | 12/2010 |
| KR | 10-2011-0003655 | 1/2011 |
| KR | 10-2011-0080101 | 7/2011 |

OTHER PUBLICATIONS

Piping Technology and Products Pipe and Suports Catalog, Insulated Shoe Support for Cold Pipe (Cold Shoe), www.pipingtech.com/products/ptpcat/pipeshoes/insulated/fig4600.htm, Archived Sep. 10, 2010, accessed Sep. 22, 2015.*

Korean Notice of Patent Allowance issued Jul. 13, 2015 in corresponding Korean Patent Application No. 9-5-2015-046670016.

* cited by examiner

*Primary Examiner* — Cassey D Bauer
(74) *Attorney, Agent, or Firm* — Staas & Halsey LLP

(57) ABSTRACT

A refrigerator is provided. The refrigerator includes an insulation structure and fastening structure of an ice-making compartment refrigerant pipe disposed at an inside an ice-making compartment configured to directly supply cooling energy by being in contact with an ice-making tray. The refrigerator includes an insulation member configured to surround the ice-making compartment refrigerant pipe, and a fixing member coupled to an outer circumferential surface of the insulation member in a shape of a loop to prevent the insulation member from being widened.

18 Claims, 8 Drawing Sheets

REFRIGERATOR

CROSS-REFERENCE TO RELATED APPLICATIONS

This application is related to, and claims priority to, Korean Patent Application No. 10-2012-0022471, filed on Mar. 5, 2012, in the Korean Intellectual Property Office, the disclosure of which is incorporated herein by reference.

BACKGROUND

1. Field

Embodiments of the present disclosure relate to a refrigerator having a direct cooling type ice-maker.

2. Description of the Related Art

A refrigerator is an apparatus configured to keep foods fresh by having a storage compartment, and a cool air supplying apparatus to supply cool air to the storage compartment. In the refrigerator, an ice-making system configured to generate ice may be provided.

The ice-making system, depending, for example, on a method of supplying cool air to an ice-making tray, may be divided into an indirect cooling type configured to transfer the cool air generated from an outside to an ice-making compartment, and a direct cooling type configured to directly supply cool air to the ice-making tray as a portion of the refrigerant pipe is inserted into the ice-making compartment and is making contact with the ice-making tray.

In a direct cooling type ice-making system, the ice-making tray may serve as a heat exchanger, and thus the ice-generating speed may be fast. However, since a portion of the refrigerant pipe may be needed to be fixed after being inserted into the ice-making compartment, an additional installation and/or manufacturing task may be needed. A frequent forming of frost may also occur at the ice-making tray and at the refrigerant pipe due to the temperature difference.

SUMMARY

It is an aspect of the present disclosure to provide an insulation structure and a fixing structure of a refrigerant pipe configured to prevent frost from forming at an ice-making compartment refrigerant pipe disposed at an ice-making compartment to be in contact with an ice-making tray, and configured to prevent the ice-making compartment refrigerant pipe from being bent or deformed.

Additional aspects of the disclosure will be set forth in part in the description which follows and, in part, will be obvious from the description, or may be learned by practice of the disclosure.

In accordance with an aspect of the present disclosure, a refrigerator includes an ice-making compartment, an ice-maker, an ice-making compartment refrigerant pipe, an insulation member and a fixing member. The ice-maker may have an ice-making tray at which ice is generated, and a drain duct to collect defrost water of the ice-making tray. The ice-making compartment refrigerant pipe may be disposed at the ice-making compartment to directly supply cooling energy to the ice-making tray, the ice-making compartment refrigerant pipe configured to make contact with the ice-making tray. The insulation member may be configured to surround the ice-making compartment refrigerant pipe to thermally insulate the ice-making compartment refrigerant pipe, and may be formed as a first insulation member and a second insulation member are coupled to each other. The fixing member may be coupled to the insulation member to prevent the first insulation member and the second insulation member from moving away from each other.

The fixing member may be coupled to an outer circumferential surface of the insulation member in a shape of a loop, so as to surround the insulation member.

The first insulation member may be coupled to an upper side of the second insulation member.

A through-hole may be formed in between the first insulation member and the second insulation member, so that the ice-making compartment refrigerant pipe passes through the through-hole.

A first groove may be formed at the first insulation member, and a second groove may be formed at the second insulation member at a position corresponding to the first insulation groove, thereby forming the through-hole.

The insulation member may include a front side protrusion part being protruded toward a front thereof, and the fixing member is coupled to the front side protrusion part.

A convex part and a concave part may be formed at the first insulation member and the second insulation member, respectively, so that the first insulation member and the second insulation member are coupled to each other in a step type.

A first convex part and a first concave part may be formed at the first insulation member. A second concave part may be formed at a position of the second insulation member corresponding to a position of the first convex part, while a second convex part may be formed at a position of the second insulation member corresponding to a position of the first concave part. The first convex part may be coupled to the second concave part, while the second convex part is coupled to the first concave part.

The fixing member may include a plurality of adhering protrusions being protruded toward an inner side thereof so as to be in contact with the insulation member.

The fixing member may include a guide protrusion that may be protruded toward an outer side thereof to guide defrost water to the drain duct.

A guide passage may be formed at the second insulation member to form a portion of an air passage of the ice-making compartment. The guide protrusion may prevent the defrost water from being introduced to the guide passage.

The fixing member may be formed as an integral unit.

The fixing member may include a first supporting part, a second supporting part and a hinge part. The first supporting part may be configured to support the first insulation member. The second supporting part may be configured to support the second insulation member. The hinge part may connect one end portion of the first supporting part to one end portion of the second supporting part. The fixing member may be folded with respect to the hinge part.

A locking protrusion may be formed at the other end portion of the first supporting part, and a locking groove may be formed at the other end portion of the second supporting part, so that the fixing member may be maintained in a folded state as the locking protrusion is insertedly coupled to the locking groove.

In accordance with an aspect of the present disclosure, a refrigerator, includes an inner case, an outer case, a storage compartment, an ice-making compartment, a cooling apparatus, an insulation member, a first fixing member and a second fixing member. The outer case may be coupled to an outer side of the inner case. The storage compartment may be formed by the inner case. The ice-making compartment may be formed to be divided from the storage compartment by an ice-making compartment case. The cooling apparatus may have a compressor, a condenser, an expansion apparatus, an evaporator, and a refrigerant pipe, the refrigerant pipe including an ice-making compartment refrigerant pipe disposed at the ice-making compartment. The insulation member may be configured to surround the ice-making compartment refrigerant pipe to thermally insulate the ice-making compartment refrigerant pipe, and the insulation member may be formed as a first insulation member and a second insulation member are coupled to each other. The first fixing member may be coupled to the insulation member to prevent the first insulation member from moving away from the second insulation member. The second fixing member may be coupled to the inner case while holding a portion of the refrigerant pipe to fix the ice-making compartment refrigerant pipe to the ice-making compartment.

The second fixing member may include a clamping part, an inner case coupling part and an insulation member coupling part. The clamping part may be configured to hold the refrigerant pipe. The inner case coupling part may be configured to be coupled to the inner case. The insulation member coupling part may allow the insulation member to be coupled thereto.

In accordance with an aspect of the present disclosure, a refrigerator includes an ice-making compartment, an ice-maker, an ice-making compartment refrigerant pipe, a first insulation member, a second insulation member and a fixing member. The ice-maker may have an ice-making tray at which ice is generated, and a drain duct to collect defrost water of the ice-making tray. The ice-making compartment refrigerant pipe may be disposed at the ice-making compartment to directly supply cooling energy to the ice-making tray, the ice-making compartment refrigerant pipe configured to make contact with the ice-making tray. The first insulation member may be configured to surround an upper portion of the ice-making compartment refrigerant pipe. The second insulation member may be configured to surround a lower portion of the ice-making compartment refrigerant pipe. The fixing member may be configured to fix the first insulation member and the second insulation member by surrounding the first insulation member and the second insulation member.

According to an exemplary embodiment of the present invention, frost forming at an ice-making compartment refrigerant pipe, which is disposed at an ice-making compartment to be in contact with an ice-making tray, may be prevented. According to an exemplary embodiment of the present invention, the ice-making compartment refrigerant pipe being bent or deformed may be prevented, while the ice-making compartment refrigerant pipe may be fixed to the ice-making compartment in a sturdy manner.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
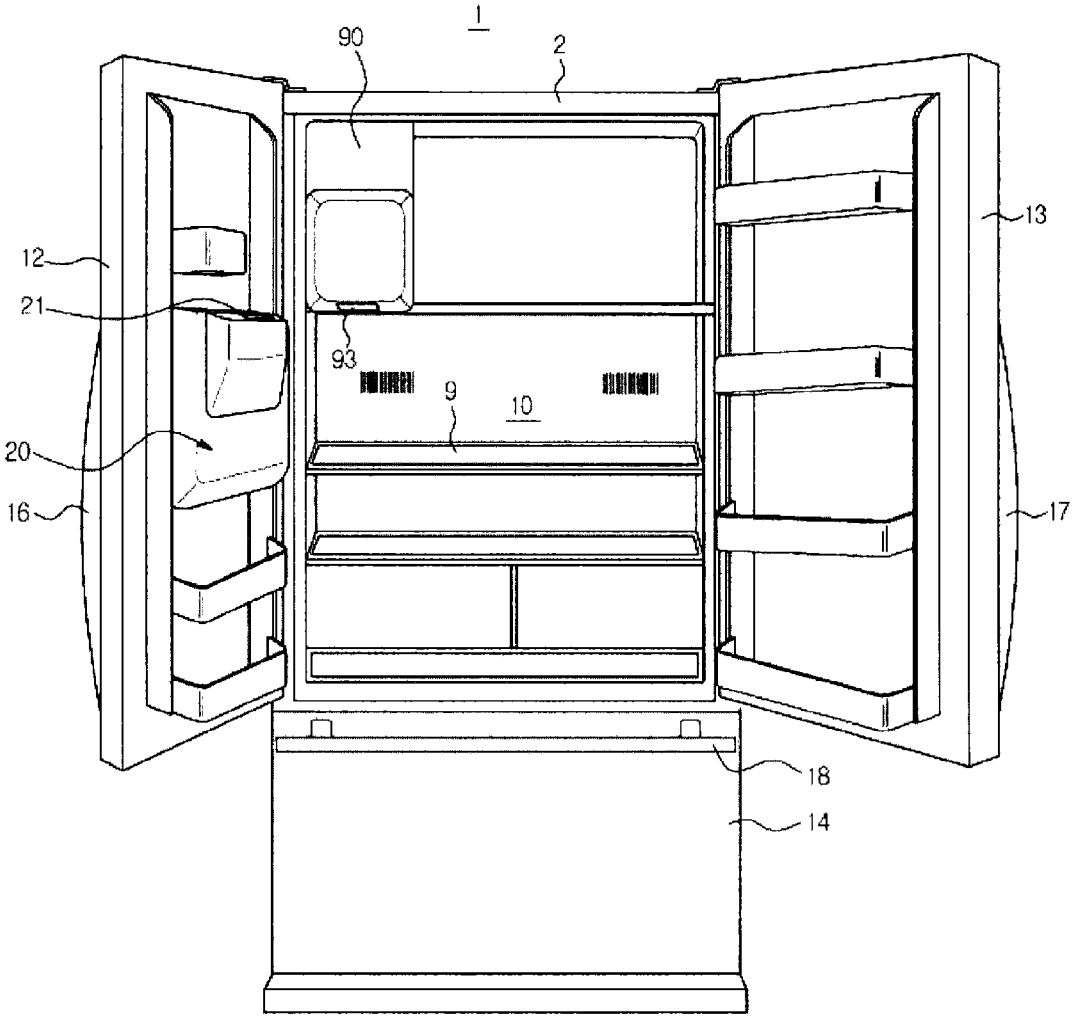
FIG. 1 illustrates a refrigerator in accordance with an embodiment of the present disclosure.

Reference will now be made in detail to the embodiments of the present disclosure, examples of which are illustrated in the accompanying drawings, wherein like reference numerals refer to like elements throughout.

Figure 2:
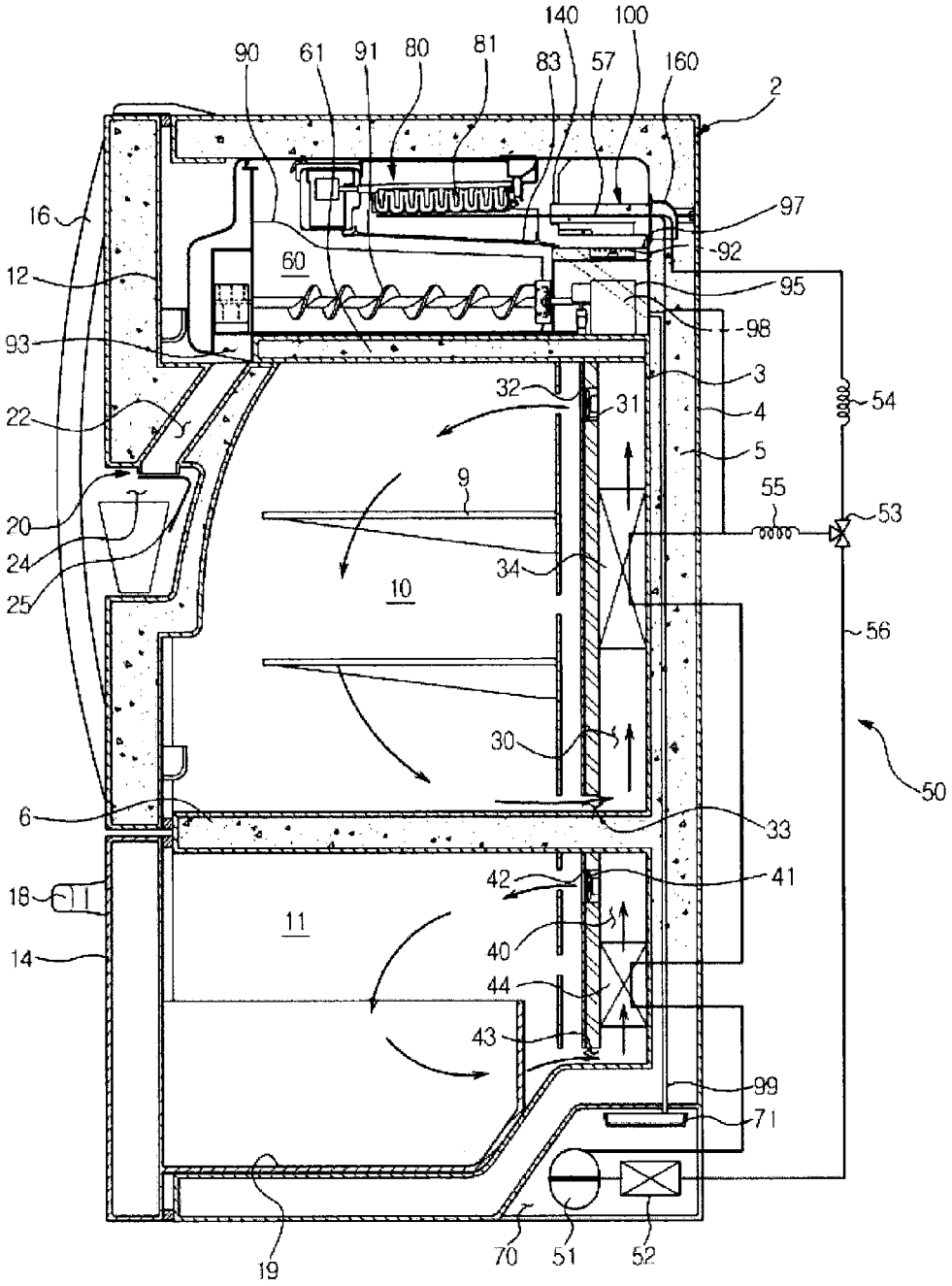
FIG. 2 illustrates an exemplary refrigerator.
Figure 3:
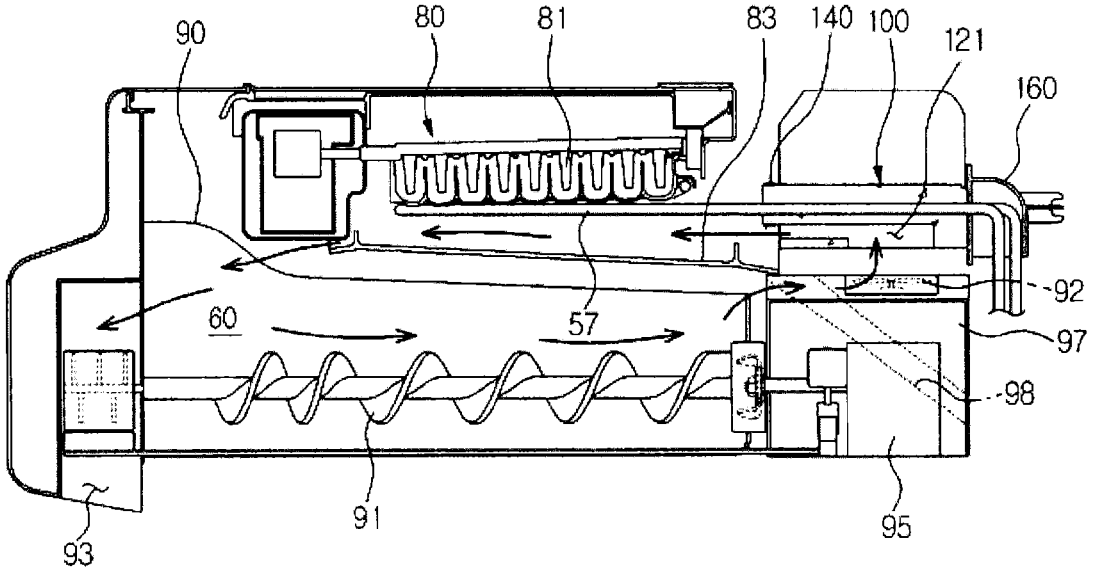
FIG. 3 illustrates an exemplary ice-making compartment of a refrigerator.

FIG. 1 is a front view of a refrigerator in accordance with an exemplary embodiment of the present disclosure, FIG. 2 is a cross-sectional view of a side of an exemplary refrigerator, and FIG. 3 is an enlarged cross-sectional side view illustrating an exemplary ice-making compartment of a refrigerator.

As illustrated on FIGS. 1 to 3, a refrigerator 1 in accordance with an embodiment of the present disclosure may include a body 2, storage compartments 10 and 11 configured to store foods in a refrigerated state or a frozen state, an ice-making compartment 60 formed while being divided from the storage compartments 10 and 11 by an ice-making compartment case 61, and a cooling apparatus 50 configured to supply cool air to the storage compartments 10 and 11 and the ice-making compartment 60.

The body 2 includes an inner case 3 forming the storage compartments 10 and 11, an outer case 4 forming an exterior appearance that may be coupled to an outer side of the inner case 3, and heat insulation material 5 that may be foamed in between the inner case 3 and the outer case 4.

The storage compartments 10 and 11 may be formed in a way that the front surfaces thereof are open Using a horizontal partition 6, the storage compartments 10 and 11 may be divided into the refrigerating compartment 10 and the freezing compartment 11 at the upper portion and the lower portion of the horizontal partition 6. The horizontal partition 6 may be provided with insulation material configured to block the heat exchange between the refrigerating compartment 10 and the freezing compartment 11.

At the refrigerating compartment 10, a shelf 9 configured to divide the storage space of the refrigerating compartment 10 into an upper portion and a lower portion may be disposed. The front surface of the refrigerating compartment 10, which is open, may be open/closed by, for example, a pair of doors 12 and 13 hinged in a rotating manner to the body 2. Handles 16 and 17 may be provided at the doors 12 and 13, respectively, so that the doors 12 and 13 may be open and closed.

The doors 12 and 13 of the refrigerating compartment 10 may be provided with a dispenser 20 through which ice may be withdrawn from an outside without having to open the doors 12 and 13. The dispenser 20 may include a dispensing space 25 from which ice may be withdrawn, a lever 25 configured to select whether to withdraw ice, and a chute 22 configured to guide the ice being discharged through an ice discharging hole 93 to the dispending space 25.

The front surface of the freezing compartment 11, which is open, may be open and closed by a sliding door 14 that may be insertedly entered into the freezing compartment 11. A storage box 19 in which foods may be stored may be integrally formed with the rear surface of the sliding door 14. On the sliding door 14, a handle 18 may be provided to open and close the sliding door 14.

As illustrated on FIG. 2, the refrigerator 1 includes the cooling apparatus 50 configured to supply cooling air to the storage compartments 10 and 11 and the ice-making compartment 60. The cooling apparatus 50 may include a compressor 51 to compress refrigerant at high pressure, a condenser 52 to condense the compressed refrigerant, expansion apparatus 54 and 55 to expand refrigerant at low pressure, evaporators 34 and 44 to generate cool air by evaporating refrigerant, and a refrigerant pipe 56 to guide refrigerant.

The compressor 51 and the condenser 52 may be disposed in a machinery space 70 provided, for example, at a lower portion of the rear of the body 2. The evaporators 34 and 44 may be disposed at a refrigerating compartment cooling air supplying duct 30 provided at the refrigerating compartment 10 and at a freezing compartment cooling air supplying duct 40 provided at the freezing compartment 11, respectively.

The refrigerating compartment cooling air supplying duct 30 includes an intake port 33, a cool air discharging port 32, and a blower fan 31, and may be configured to circulate cool air at an inside the refrigerating compartment 10. The freezing compartment cooling air supplying duct 40 includes an intake port 43, a cool air discharging port 42, and a blower fan 41, and may be configured to circulate cool air at an inside the freezing compartment 11. Thus, the refrigerating compartment 10 and the freezing compartment 11 may be independently cooled from each other.

The refrigerant pipe 56 is configured to allow the refrigerant to sequentially flow through the ice-making compartment 60, the refrigerating compartment 10, and the freezing compartment 11, or may be split at a certain point so that the refrigerant may be introduced only to the refrigerating compartment 10 and the freezing compartment 11 while the ice-making compartment 60 is excluded, and at the certain point, a divert valve 53 configured to convert the passage of the refrigerant may be installed.

A portion 57 of the refrigerant pipe 56 may be disposed inside the ice-making compartment 60 to cool the ice-making compartment 60. The refrigerant pipe 57 disposed at an inside the ice-making compartment 60 is being in contact with the ice-making tray 81 of the ice-maker 80, and may be able to directly supply cooling energy to the ice-making tray 81. A portion 57 of the refrigerant pipe 56 may be disposed at an inside the ice-maker 60 so as to be in contact with the ice-making tray 81 of the ice-maker 80. Such a portion may be referred to as an ice-making compartment refrigerant pipe.

An ice-maker 80 includes the ice-making tray 81 at which ice is generated, and a drain duct 83 disposed at a lower side of the ice-making tray 81 and configured to collect the defrost water of the ice-making tray 81. The drain duct 83 collects defrost water, and may guide the defrost water to a first discharging passage 98. The defrost water guided to the first discharging passage 98, through a second discharging passage 99, may flow to an evaporator dish 71 provided at the machinery space 70.

At a lower side of the ice-maker 80, an ice bucket 90 may be configured to store the ice generated at the ice-making tray 81. At the ice bucket 90, an auger 91 may be configured to transfer the stored ice to an ice discharging port 93.

At a rear of the ice bucket 90, an auger motor 95 configured to drive the auger 91, the first discharging passage 98 configured to guide the defrost water being guided through the drain duct 83 to an outside the ice-making compartment 60, and a blower fan 92 configured to forcedly flow the air inside the ice-making compartment 60 may be provided. The auger motor 95, the first discharging passage 98, and the blower fan 92 may be integrally formed with one another while mounted at an inside or an outside a case 97, and may be disposed at a lower side of an insulation member 100.

The air that flows in a forced manner by the blower fan 92 may be circulated inside the ice-making compartment 60, for example, in a direction of an arrow illustrated in FIG. 3. That is, the air discharged to an upper side the blower fan 92, through a guide passage 121 formed at an inside the insulation member 100, may flow in between the ice-making tray 81 and the drain duct 83. The air exchanges heat with the ice-making tray 81 and the ice-making compartment refrigerant pipe 57. The air, which is cooled, flows to a side of the ice discharging port 93 of the ice bucket 90, and then may be taken in into the blower fan 92.

The ice-making compartment refrigerant pipe 57 may be inserted into an inside the ice-making compartment 60 by penetrating through the inner case 3. The ice-making compartment refrigerant pipe 57 may be insulated and fixed by the insulation member 100 and a first fixing member 140 and a second fixing member 160. The insulation member 100, the first fixing member 140, and the second fixing member 160 are described.

Figure 4:
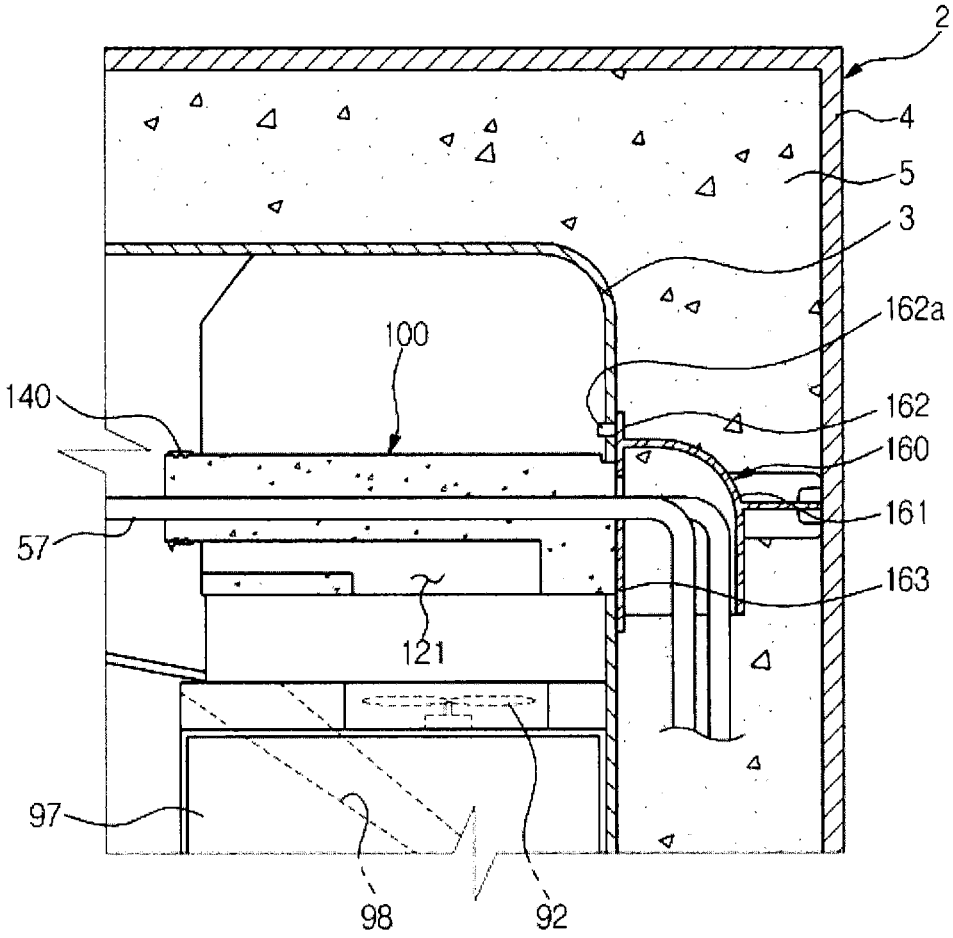
FIG. 4 illustrates an exemplary insulation structure and a fixing structure of an ice-making compartment refrigerant pipe of a refrigerator.
Figure 5:
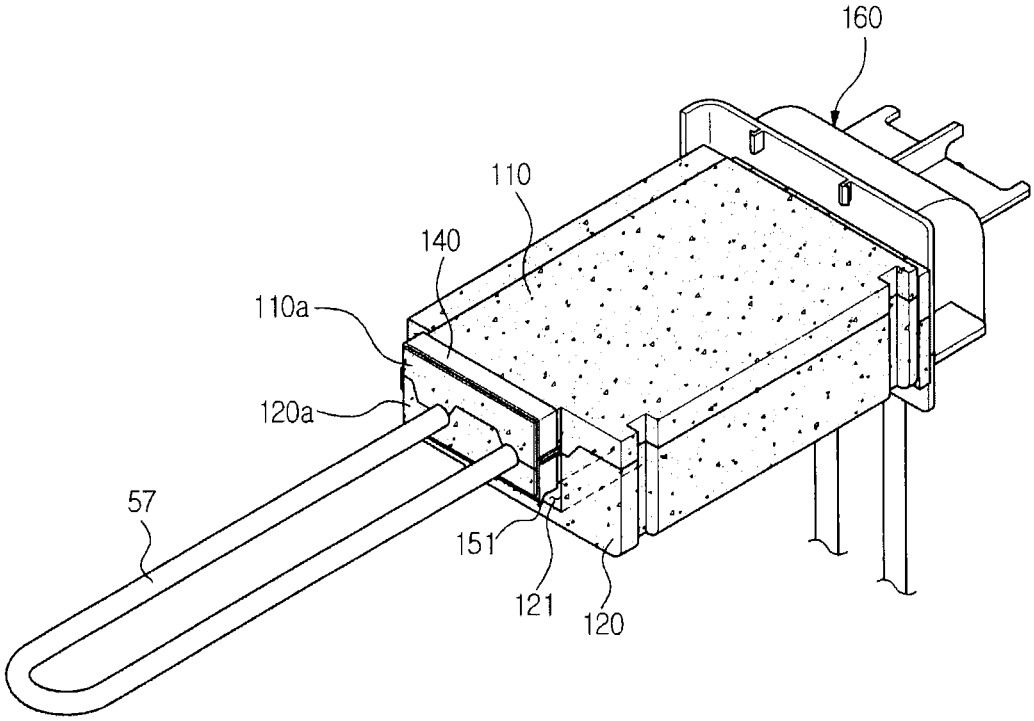
FIG. 5 illustrates an exemplary insulation structure and fixing structure of an ice-making compartment refrigerant pipe of a refrigerator.
Figure 6:
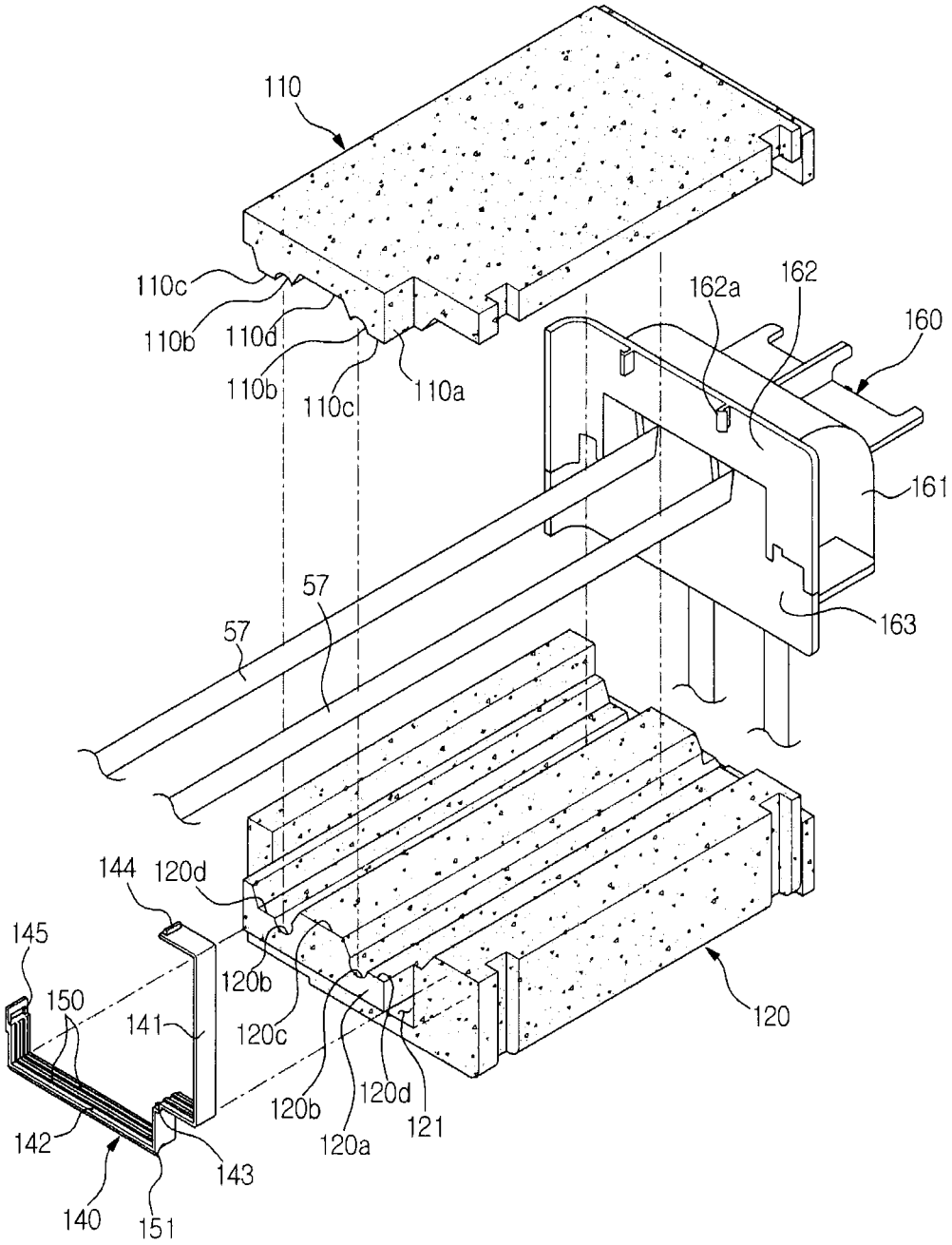
FIG. 6 illustrates an exemplary insulation structure and fixing structure of the ice-making compartment refrigerant pipe of the refrigerator.
Figure 7:
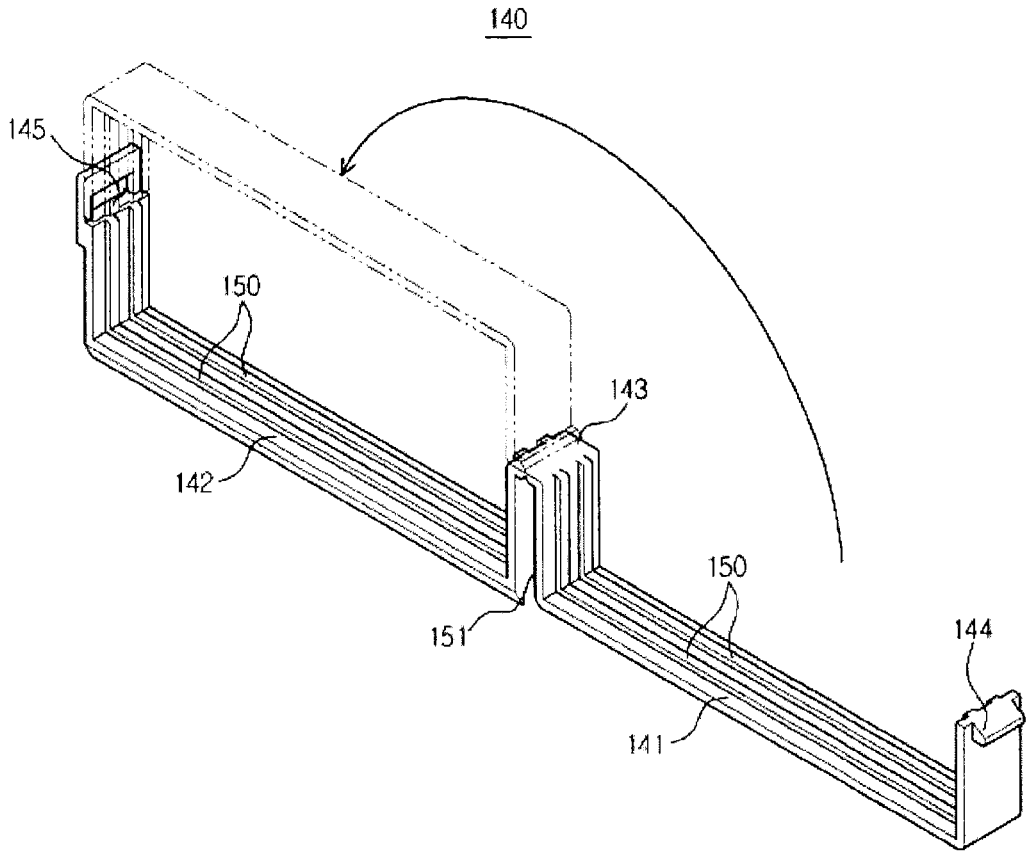
FIG. 7 illustrates an exemplary fixing member of a refrigerator.
Figure 8:
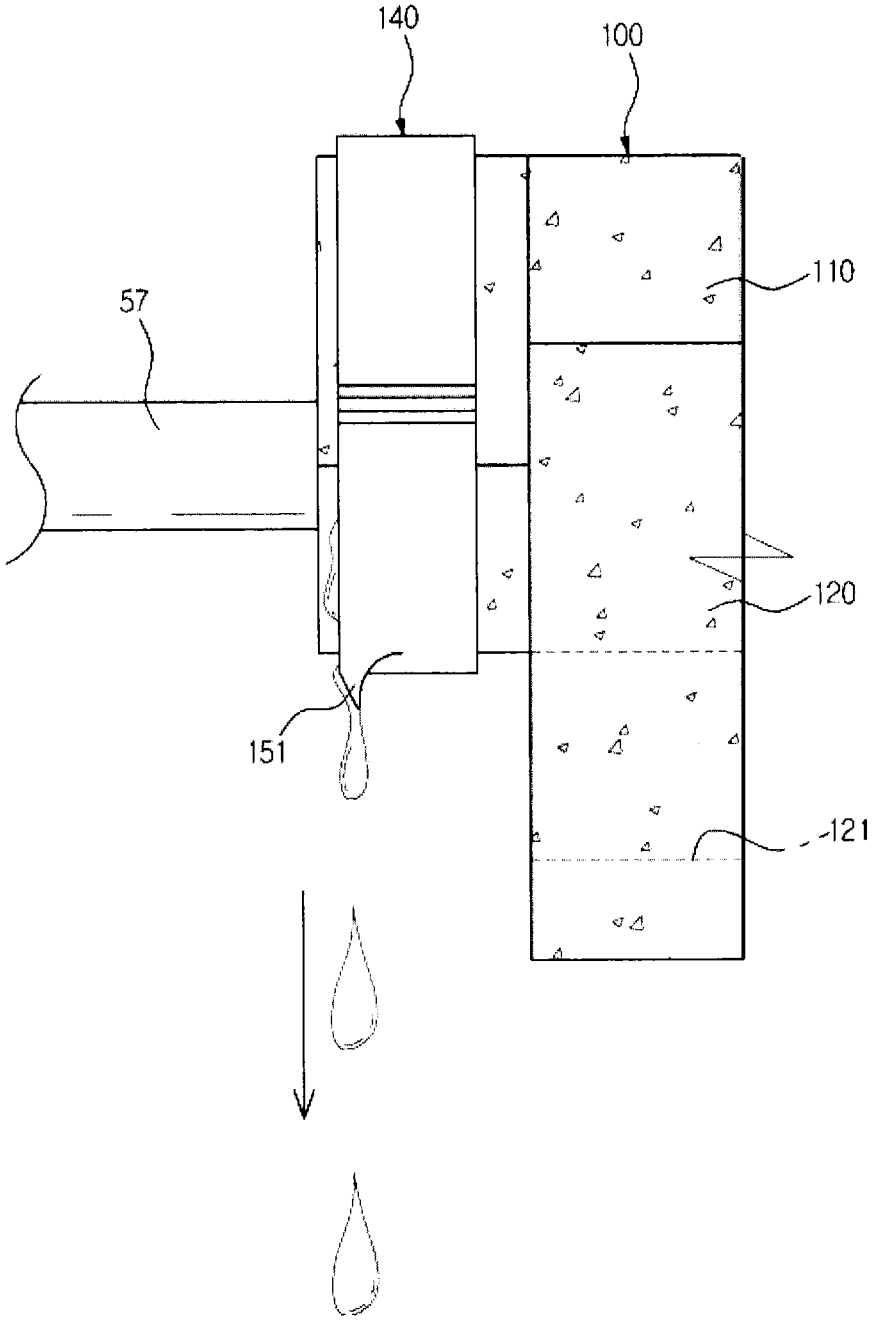
FIG. 8 illustrates an exemplary state of the defrost water being guided by a guide protrusion of a fixing member of a refrigerator.

FIG. 4 is a cross-sectional side view illustrating an exemplary insulation structure and a fixing structure of an ice-making compartment refrigerant pipe of a refrigerator of FIG. 1. FIG. 5 is a perspective view illustrating an exemplary insulation structure and a fixing structure of an ice-making compartment refrigerant pipe of a refrigerator. FIG. 6 is an exploded perspective view illustrating an exemplary insulation structure and a fixing structure of an ice-making compartment refrigerant pipe of a refrigerator. FIG. 7 illustrates a fixing member of a refrigerator, and FIG. 8 illustrates an exemplary state of the defrost water being guided by a guide protrusion of a fixing member of a refrigerator.

As illustrated in FIGS. 4 to 8, the insulation member 100, by surrounding the ice-making compartment refrigerant pipe 57, insulates the ice-making compartment refrigerant pipe 57 while preventing the deformation of the ice-making compartment refrigerant pipe 57, such as being bent, from occurring. The insulation member 100 may be provided with insulation material such as Styrofoam. The insulation member 100 may be formed as a first insulation member 110 at an upper side and a second insulation member 120 at a lower side are coupled to each other. The first insulation member 110 and the second insulation member 120 may be coupled to each other by use of adhesive.

Grooves 110*b* and 120*b* may be respectively formed at corresponding positions to each other at the first insulation member 110 and at the second insulation member 120 such that the ice-making compartment refrigerant pipe 57 may be mounted at the grooves 110*b* and 120*b*, and as the grooves 110*b* and 120*b* are coupled to each other to form a through-hole that allows the ice-making compartment refrigerant pipe 57 to pass through the insulation member 100.

At the first insulation member 110, a convex part 110*c* protruded toward an outer side, and a concave part 110*d* indented toward an inner side may be formed in turn. At the second insulation member 120, a concave part 120*d* indented toward an inner side may be formed at a position corresponding to the convex part 110*c* of the first insulation member 110 and a convex part 120*c* protruded toward an outer side may also be formed at a position corresponding to the concave part 110*d* at the second insulation member 120.

Thus, as the convex part 110*c* of the first insulation member 110 is coupled to the concave part 120*d* of the second insulation member 120, and as the concave part 110*d* of the first insulation member 110 is coupled to the convex part 120*c* of the second insulation member 120, the first insulation member 110 and the second insulation member 120 may be coupled to each other. By the step-type coupling structure as such, the adherency of the first insulation member 110 and the second insulation member 120 is enhanced, and the formation of the frost, as the air having moisture is penetrated in between the first insulation member 110 and the second insulation member 120, may be prevented.

At the second insulation member 120, the guide passage 121 configured to form a portion of the air passage at an inside the ice-making compartment 60 may be formed. The guide passage 121 is provided at a lower side thereof with an entry portion, and provided at a front thereof with an exit unit, so that the air discharged from the blower fan 92 disposed at a lower side of the guide passage 121 may be guided to a front.

The refrigerator 1 in accordance with an embodiment of the present disclosure includes the first fixing member 140 configured to enhance the adherency of the first insulation member 110 and the second insulation member 120 while preventing the first insulation member 110 from moving away from the second insulation member 120. The first fixing member 140 is coupled to outer circumferential surfaces of the first insulation member 110 and the second insulation member 120, and prevents the first insulation member 110 and the second insulation member 120 from being spaced apart from each other.

The first fixing member 140 may be coupled to a front end of the insulation member 100, and may be able to prevent the air having moisture from penetrating through the front surface of the insulation member 100. The insulation member 100 may be provided with a front side protrusion part 100*a* having a relatively narrow width so that the first fixing member 140 may be easily coupled to the insulation member 100. The front side protrusion part 100*a* of the insulation member 100 may be formed as a front side protrusion part 110*a* of the first insulation member 110 and a front side protrusion part 120*a* of the second insulation member 120 are coupled to each other.

The first fixing member 140 includes a first supporting part 141 configured to support the first insulation member 110 while being in close contact with the first insulation member 110, a second supporting part 142 configured to support the second insulation member 120 while being in close contact with the second insulation member 120, and a hinge part 143 connecting one end portion of the first supporting part 141 to one end portion of the second supporting part 142. The first fixing member 140 may be folded while having the hinge part 143 as a center.

At the other end portion of the first supporting part 141, a locking protrusion 144 may be formed. At the other end portion of the second supporting part 142, a locking groove 145 into which the locking protrusion 144 may be insertedly coupled may be formed. Thus, after the second supporting part 142 contacts with the second insulation member 120 and the first supporting part 141 is folded to be in close contact with the first insulation member 110, the locking protrusion 144 may be insertedly coupled to the locking groove 145, so that the first fixing member 140 may be coupled to the insulation member 100 while maintaining a folded state.

At an inner side surface of the first fixing member 140, to prevent the first fixing member 140 from being loose from the insulation member 100, a plurality of adhering protrusions 150 may be formed. The plurality of adhering protrusions 150 may be consecutively formed at the first supporting part 141 and at the second supporting part 142 lengthwise along the first fixing member 140.

At an outer side surface of the first fixing member 140, a guide protrusion 151 configured to guide defrost water may be formed. The guide protrusion 151 is protruded toward a lower side to guide the defrost water to fall downward while traveling on the guide protrusion 151. The defrost water that falls downward while traveling on the guide protrusion 151 may be collected by the drain duct 83 (as illustrated in FIG. 2), and may be discharged to an outside the ice-making compartment 60.

As the defrost water is guided toward a lower side by the guide protrusion 151, the defrost water is prevented from penetrating to the guide passage 121, which is formed at the insulation member 100, and thus the guide passage 121 being clogged by freezing may be prevented.

A refrigerator 1 in accordance with an embodiment of the present disclosure may further include a second fixing member 160 configured to fix the ice-making compartment refrigerant pipe 57 to the ice-making compartment 60. As illustrated in FIG. 4, the second fixing member 160 may be coupled to an outer side of the inner case 3 while holding the refrigerant pipe 56, and thus the ice-making compartment refrigerant pipe 57 may be fixed to the ice-making compartment 60.

The second fixing member 160 may include a clamping part 161 configured to hold the refrigerant pipe 56, an inner case coupling part 162 being coupled to the inner case 3, and an insulation member coupling part 163 to which the insulation member 100 is coupled. The inner case coupling part 162 and the insulation member coupling part 163 may be integrally formed with each other in a shape of a single panel. At the inner case coupling part 162, a coupling protrusion 162*a* configured to be insertedly coupled to the inner case 30 may be formed.

The insulation member 100 may be coupled to the insulation member coupling part 163 by use of an adhesive, and thus the front surface portion of the insulation member 100 may be fixed by the first fixing member 140 so as to be prevented from being split and the rear surface portion of the insulation member 100 may be fixed by the second fixing member 160 so as to be prevented from being split.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

an ice-making compartment;

an ice-maker having an ice-making tray at which ice is generated, and a drain duct to collect defrost water of the ice-making tray;

an ice-making compartment refrigerant pipe disposed at the ice-making compartment to directly supply cooling energy to the ice-making tray, the ice-making compartment refrigerant pipe configured to make contact with the ice-making tray;

an insulation member configured to surround the ice-making compartment refrigerant pipe to thermally insulate the ice-making compartment refrigerant pipe, and formed as a first insulation member and a second insulation member coupled to each other;

a fixing member coupled to the insulation member to prevent the first insulation member and the second insulation member from moving away from each other; and a guide passage is formed at the second insulation member to form a portion of an air passage of the ice-making compartment.

2. The refrigerator of claim 1, wherein:

the fixing member is coupled to an outer circumferential surface of the insulation member in a shape of a loop, so as to surround the insulation member.

3. The refrigerator of claim 1, wherein:

the first insulation member is coupled to an upper side of the second insulation member.

4. The refrigerator of claim 1, wherein:

a through-hole is formed in between the first insulation member and the second insulation member, so that the ice-making compartment refrigerant pipe passes through the through-hole.

5. The refrigerator of claim 4, wherein:

a first groove is formed at the first insulation member, and a second groove is formed at the second insulation member at a position corresponding to the first insulation groove, thereby forming the through-hole.

6. The refrigerator of claim 1, wherein:

the insulation member comprises a front side protrusion part being protruded toward a front thereof, and the fixing member is coupled to the front side protrusion part.

7. The refrigerator of claim 1, wherein:

a convex part and a concave part are formed at the first insulation member and the second insulation member, respectively, so that the first insulation member and the second insulation member are coupled to each other in a step type.

8. The refrigerator of claim 7, wherein:

a first convex part and a first concave part are formed at the first insulation member, a second concave part is formed at a position of the second insulation member corresponding to a position of the first convex part, while a second convex part is formed at a position of the second insulation member corresponding to a position of the first concave part, and the first convex part is coupled to the second concave part, while the second convex part is coupled to the first concave part.

9. The refrigerator of claim 1, wherein:

the fixing member comprises a plurality of adhering protrusions being protruded toward an inner side thereof so as to be in contact with the insulation member.

10. The refrigerator of claim 1, wherein:

the fixing member comprises a guide protrusion protruded toward an outer side thereof to guide defrost water to the drain duct.

11. The refrigerator of claim 10, wherein:

the guide protrusion prevents the defrost water from being introduced to the guide passage.

12. The refrigerator of claim 1, wherein:

the fixing member is formed as an integral unit.

13. The refrigerator of claim 1, wherein:

the fixing member comprises a first supporting part to support the first insulation member, a second supporting part to support the second insulation member, and a hinge part connecting one end portion of the first supporting part to one end portion of the second supporting part, and the fixing member is folded with respect to the hinge part.

14. The refrigerator of claim 13, wherein:

a locking protrusion is formed at the other end portion of the first supporting part, and a locking groove is formed at the other end portion of the second supporting part, so that the fixing member is maintained in a folded state as the locking protrusion is insertedly coupled to the locking groove.

15. The refrigerator of claim 1, wherein:

the fixing member includes an inner case coupling part, and the inner case is coupled to the inner case coupling part of the fixing member.

16. A refrigerator, comprising:

an ice-making compartment;

an ice-maker having an ice-making tray at which ice is generated, and a drain duct to collect defrost water of the ice-making tray;

an ice-making compartment refrigerant pipe disposed at the ice-making compartment to directly supply cooling energy to the ice-making tray, the ice-making compartment refrigerant pipe configured to make contact with the ice-making tray; a first insulation member configured to surround an upper portion of the ice-making compartment refrigerant pipe;

a second insulation member configured to surround a lower portion of the ice-making compartment refrigerant pipe;

a fixing member configured to fix the first insulation member and the second insulation member by surrounding the first insulation member and the second insulation member; and a guide passage is formed at the second insulation member to form a portion of an air passage of the ice-making compartment.

17. A refrigerator including an ice-making compartment, comprising:

an ice-making tray;

a drain duct to collect defrost water from the ice-making tray;

a pipe to directly cool the ice-making tray;

a plurality of insulation members, including at least a first and second insulation member, surrounding the pipe, the plurality of insulation members are coupled to each other by a fixing member; and a guide passage is formed at the second insulation member to form a portion of an air passage of the ice-making compartment.

18. The refrigerator of claim 16, wherein:

the fixing member includes an inner case coupling part, and the inner case is coupled to the inner case coupling part of the fixing member.

* * * * *